US006730878B2

(12) United States Patent
Hirai

(10) Patent No.: US 6,730,878 B2
(45) Date of Patent: May 4, 2004

(54) HEATER HAVING ELECTRICALLY CONDUCTIVE SUBSTRATE AND IMAGE HEATING APPARATUS WITH HEATER

(75) Inventor: Masahide Hirai, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 47 days.

(21) Appl. No.: 10/034,307

(22) Filed: Jan. 3, 2002

(65) Prior Publication Data

US 2002/0088789 A1 Jul. 11, 2002

(30) Foreign Application Priority Data

Jan. 5, 2001 (JP) ..... 2001-000639
Feb. 16, 2001 (JP) ..... 2001-040328

(51) Int. Cl.[7] ..... G03G 15/20; H05B 3/18

(52) U.S. Cl. ..... 219/216; 219/521; 219/530; 219/536; 219/544; 399/333

(58) Field of Search ..... 219/216, 469, 219/521, 530, 536, 544; 399/329, 334

(56) References Cited

U.S. PATENT DOCUMENTS 4,970,219 A 11/1990 Effland et al. ..... 514/339
5,149,941 A 9/1992 Hirabayashi et al. ..... 219/216
5,367,369 A * 11/1994 Nakai et al. ..... 219/216
5,920,757 A * 7/1999 Izawa et al. ..... 399/329
6,175,699 B1 1/2001 Kato et al. ..... 399/69
6,518,546 B2 * 2/2003 Otsuka et al. ..... 219/216

FOREIGN PATENT DOCUMENTS

| | | |
|---|---|---|
| JP | 63-313182 | 12/1988 |
| JP | 2-157878 | 6/1990 |
| JP | 9-244442 | 9/1997 |
| JP | 10-275671 | 10/1998 |

* cited by examiner

*Primary Examiner*—Joseph Pelham
(74) *Attorney, Agent, or Firm*—Fitzpatrick, Cella, Harper & Scinto

(57) ABSTRACT

An image heating apparatus for heating an image formed on a recording material has a heater having a heat generating resistor, an electrically conductive substrate, an intermediate insulating layer formed between the resistor and the substrate and two surface insulating layers provided on substantially entire areas of both surfaces of the substrate. The surface insulating layer on that surface side of the substrate which is opposed to the recording material is higher in heat conductivity than the surface insulating layer on the opposite surface side.

44 Claims, 12 Drawing Sheets

HEATER FRONT SIDE

HEATER BACK SIDE
TO PRIMARY CIRCUIT SYSTEM AC
TO SECONDARY CIRCUIT SYSTEM DC
3
30
31
32
33
34
35
36
37
37a
38
38a

HEATER FRONT SIDE
3 : FRONT SIDE HEATING TYPE
31
34
35
32
30
33

3

HEATER BACK SIDE
(THERMISTOR ABUTMENT AREA WITHOUT INSULATING GLASS LAYER 36)
39
TO SECONDARY CIRCUIT SYSTEM DC (10)
37a
36
37
38a
38
TO PRIMARY CIRCUIT SYSTEM AC (11)

THERMISTOR ABUTMENT AREA WITHOUT INSULATING GLASS LAYER 36

WITH INSULATING GLASS LAYER 36

HEATER FRONT SIDE

HEATER BACK SIDE

HEATER HAVING ELECTRICALLY CONDUCTIVE SUBSTRATE AND IMAGE HEATING APPARATUS WITH HEATER

BACKGROUND OF THE INVENTION

1. Field of the Invention

The invention relates to a heater having an electrically conductive substrate and an image heating apparatus such as a heating and fixing apparatus carried on an image forming apparatus such as a copier or a printer.

2. Description of Related Art

In an image output apparatus such as a copier, a printer or a facsimile apparatus using a suitable image forming process such as electrophotographic, electrostatic recording or magnetic recording, a heating apparatus of the heat roller type has heretofore been used as a fixing apparatus for fixing a toner image formed and borne on a recording material by a transferring method or a direct method on the surface of the recording material.

The heating apparatus of the heat roller type basically comprises a metallic roller provided with a heater therein, and a pressure roller having elasticity and brought into pressure contact therewith, and a recording material as a member to be heated is introduced into a fixing nip part (pressure contact nip part) formed by the pair of rollers and is nipped and conveyed by the fixing nip part to thereby heat and pressurize a toner image and fix it on the recording material.

In such a heating apparatus of the heat roller type, however, the heat capacity of the roller is great and therefore, much time has been required to raise the surface of the roller to a fixing temperature. This also has led to the problem that to execute the image outputting operation quickly, the surface of the roller must be controlled to a certain degree of temperature even when the apparatus is not used.

So, heating apparatus devised to solve these problems include heating apparatuses of the film heating type disclosed, for example, in Japanese Patent Application Laid-Open No. 63-313182, Japanese Patent Application Laid-Open No. 2-157878, etc. filed by the applicant.

Such heating apparatus of the film heating type usually comprises a thin heat-resistant film, a heating member (hereinafter referred to as the heater) fixedly supported and disposed on one surface side of the film, and a pressure member disposed on the other surface side of the film in opposed relationship with the heater for bringing a member to be heated into close contact with the heater with the film interposed therebetween.

The member to be heated, i.e., in an image heating apparatus, a recording material having a toner image formed and borne thereon, is introduced and passed between the film and the pressure member in a pressure contact nip part formed by the pressure contact between the heater and the pressure member with the film interposed therebetween, whereby the visible image bearing surface of the recording material is heated by the heater through the film, and heat energy is imparted to the unfixed image, and the toner is softened and fused, whereby the heating and fixing of the image are done.

The film heating type is excellent for its quick starting property, and can greatly curtail the electric power consumption during the standby state, and can constitute a heating apparatus of the on-demand type.

Heretofore, in a fixing apparatus adopting such a film heating type, for example, as the heater, use has often been made of a ceramic substrate such as alumina as a substrate as in a ceramic heater, but this has posed the problems of the fragility or high cost of ceramics, and the unsuitability of ceramics for bending.

So, in Japanese Patent Application Laid-Open No. 9-244442 and Japanese Patent Application Laid-Open No. 10-275671, there is proposed a heating member (a conductive substrate heater, hereinafter referred to as the metallic heater) comprising a substrate given insulating property equal to that of a conventional ceramic substrate by forming an insulating layer on a metal material, and a heat generating resistance pattern, an electrically conducting pattern and an uppermost insulating sliding layer formed thereon.

By using a conductive substrate such as a metallic substrate high in heat conductivity as the substrate material of the heater, as described above, the temperature of the heater can be uniformalized over the entire area thereof and particularly, the temperature fall in the opposite end portions thereof can be prevented, whereby there can be formed a good image free of the unevenness of image such as uneven fixing, uneven luster or offset liable to occur over the length of a recording material. The temperature rise speed of the heater can also be improved, and it becomes possible to enhance the quick starting property. Further, as compared with ceramics or the like, the rupture strength itself of the metallic substrate is very high and therefore, there is no rupture of the substrate against heat stress or the like occurring during the sudden temperature rise of the heater, and the arising of a problem such as the breakage of the substrate in the manufacturing process can be suppressed, and it becomes possible to enhance productivity.

Also, to raise the temperature more quickly as the heater, it is necessary to efficiently give the heat of the heater to a member to be heated, and as a characteristic necessary for the heater, it is desirable to improve the heat conduction of the surface side of the heater (that surface side opposed to the member to be heated, or the paper passing surface side, hereinafter the same) and efficiently impart heat to the film and the recording material and at the same time, have on the back side of the heater (the surface side opposite to the surface side opposed to the member to be heated, or the non-paper passing surface side, hereinafter the same) such an adiabatic effect as will suppress the escape of heat to a heater supporting member or the like to the utmost.

SUMMARY OF THE INVENTION

The present invention has been made in view of the above-noted problems and an object thereof is to provide a heater which is high in strength and of which the adiabatic property of one surface is high and an image heating apparatus using the heater.

Another object of the present invention is to provide an image heating apparatus comprising a heater including a heat generating resistor, an electrically conductive substrate, an intermediate insulating layer formed between said resistor and said substrate and two surface insulating layers provided respectively on substantially entire areas of both surfaces of the two substrates, wherein the surface insulating layer on that surface side of the substrate which is opposed to a recording material is higher in heat conductivity than the surface insulating layer on the opposite surface side.

Still another object of the present invention is to provide a heater comprising:

a heat generating resistor;

an electrically conductive substrate; and surface insulating layers provided on both surfaces of the substrate;

wherein the surface insulating layers differ in heat conductivity from each other.

Yet still another object of the present invention is to provide an image heating apparatus comprising a heater including a heat generating resistor, an electrically conductive substrate and surface insulating layers provided on both surfaces of the substrate, wherein the surface insulating layer on the side opposite to that surface of the substrate which is opposed to a recording material is greater in surface roughness than the surface insulating layer on the opposed surface side.

A further object of the present invention is to provide a heater comprising:

a heat generating resistor;

an electrically conductive substrate; and surface insulating layers provided on both surfaces of the substrate;

wherein the surface insulating layers differ in surface roughness from each other.

Still a further object of the present invention is to provide an image heating apparatus comprising a heater including a heat generating resistor, an electrically conductive substrate, surface insulating layers provided on both surfaces of the substrate, and a temperature detecting element for detecting the temperature of the heater, wherein that area of the heater to which the temperature detecting element is opposed is higher in heat conductivity than the peripheral area thereof.

Yet still a further object of the present invention is to provide a heater comprising:

a heat generating resistor;

an electrically conductive substrate; and surface insulating layers provided on both surfaces of the substrate, wherein one surface of the heater has in a lengthwise portion thereof an area higher in heat conductivity than the peripheral area thereof.

Further objects of the present invention will become apparent from the following detailed description when read with reference to the accompanying drawings.

DESCRIPTION OF THE PREFERRED EMBODIMENTS

Some embodiments of the present invention will hereinafter be described with reference to the drawings.

[First Embodiment]

(1) Example of the Image Forming Apparatus

Figure 1:
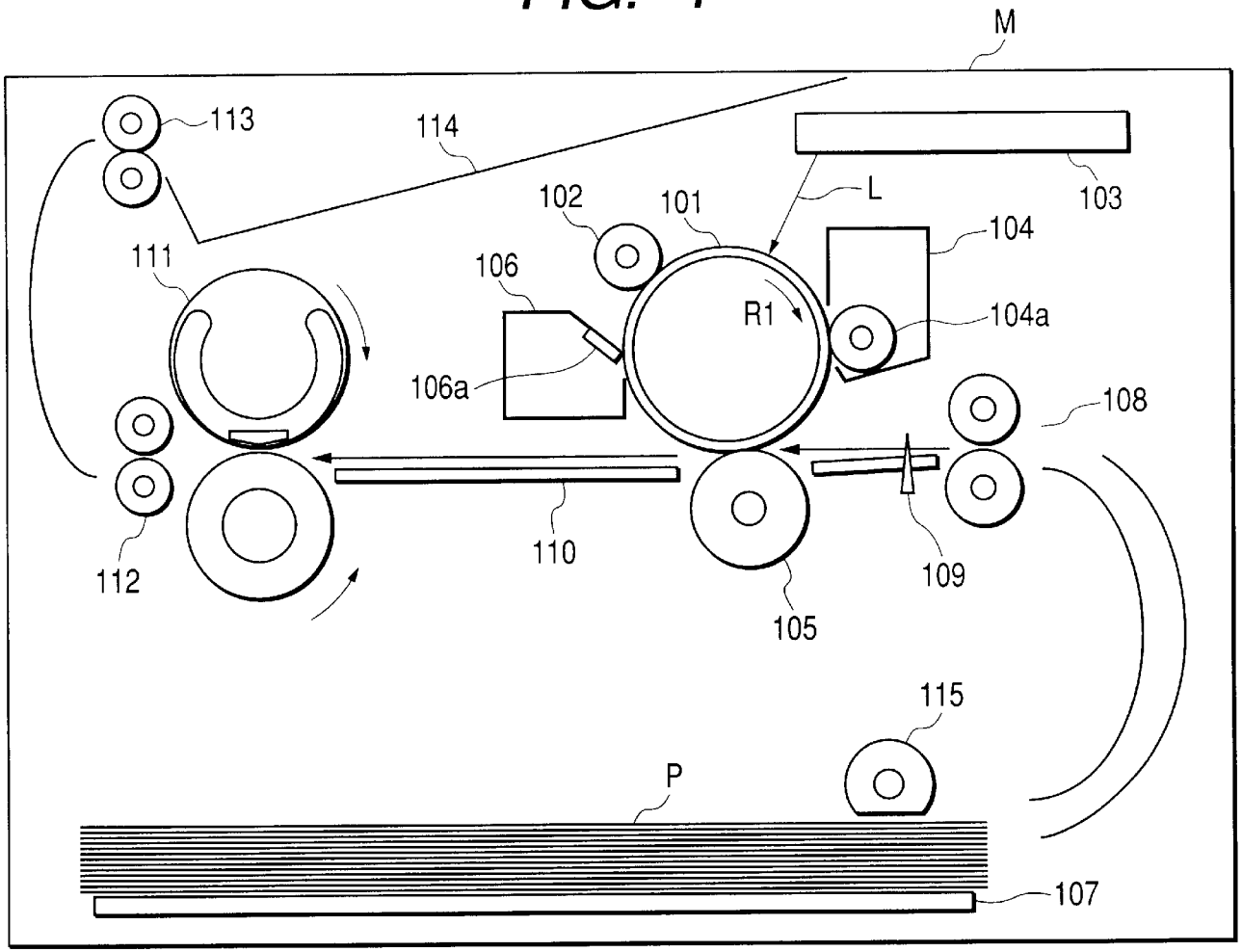
FIG. 1 is a schematic cross-sectional view of a printer carrying the image heating apparatus of the present invention thereon.

FIG. 1 is a model view schematically showing the construction of an example of an image forming apparatus. The image forming apparatus is, for example, a copier, a printer, a facsimile apparatus or the like utilizing the transfer type electrophotographic process.

The reference numeral 101 designates a drum-shaped electrophotographic photosensitive member (hereinafter referred to as the photosensitive drum) as an image bearing member. The photosensitive drum 101 is rotatably supported in the main body M of the image forming apparatus, and is rotatively driven at a predetermined process speed in the clockwise direction indicated by the arrow R1 by driving means (not shown).

Around the photosensitive drum 101, a charging roller (charging device) 102, exposing means 103, a developing device 104, a transferring roller (transferring device) 105 and a cleaning device 106 are disposed in succession along the direction of rotation thereof.

Also, a feed cassette 107 containing therein sheet-shaped recording materials (transferring materials) P such as paper is disposed in the lower portion of the main body M of the image forming apparatus. A feed roller 115, transporting rollers 108, a top sensor 109, a transferring roller 105, a transporting guide 110, a heating and fixing apparatus 111, fixing delivery rollers 112, delivery rollers 113 and a delivery tray 114 are disposed along the transporting path of the recording materials P in succession from the upstream side.

The photosensitive drum 101 driven by the driving means to rotate in the direction indicated by the arrow R1 is uniformly charged to a predetermined polarity and a predetermined voltage by the charging roller 102.

The photosensitive drum 101 after charged has its surface subjected to image exposure L based on image information by the exposing means 103 such as a laser optical system, whereby charges on the exposed portion are removed and an electrostatic latent image is formed.

The electrostatic latent image is developed by the developing device 104. The developing device 104 has a developing roller 104*a*, to which a developing bias voltage is applied to thereby cause a toner to adhere to the electrostatic latent image on the photosensitive drum 101 and develop (visualize) the latent image into a toner image.

The toner image is transferred to the recording material P such as paper by the transferring roller 105. The recording material P is contained in the feed cassette 107, is fed by the feed roller 115, is transported by the transporting rollers 108, and is transported to the transferring nip part between the photosensitive drum 101 and the transferring roller 105 through the top sensor 109. At this time, the recording material P has its leading edge detected by the top sensor 109 and is synchronized with the toner image on the photosensitive drum 101. A transferring bias voltage is applied to the transferring roller 105, whereby the toner image on the photosensitive drum 101 is transferred to a predetermined location on the recording material P.

The recording material P bearing an unfixed image on its surface by the transfer is transported to the heating and fixing apparatus 111 along the transporting guide 110, whereby the unfixed toner image is heated and pressurized, and is fixed on the surface of the recording material P.

After the toner image has been fixed, the recording material P is transported by the fixing delivery rollers 112 and is delivered onto the delivery tray 114 on top of the main body M of the image forming apparatus by the delivery rollers 113.

On the other hand, the photosensitive drum 101 after the transfer of the toner image has any toner not transferred to the recording material P and residual on the drum (untransferred toner) removed by the cleaning blade 106*a* of the cleaning device 106, and is used for the next image formation.

By the above-described operation being repeated, image formation can be effected one after another.

(2) Heating and Fixing Apparatus 111

Figure 2:
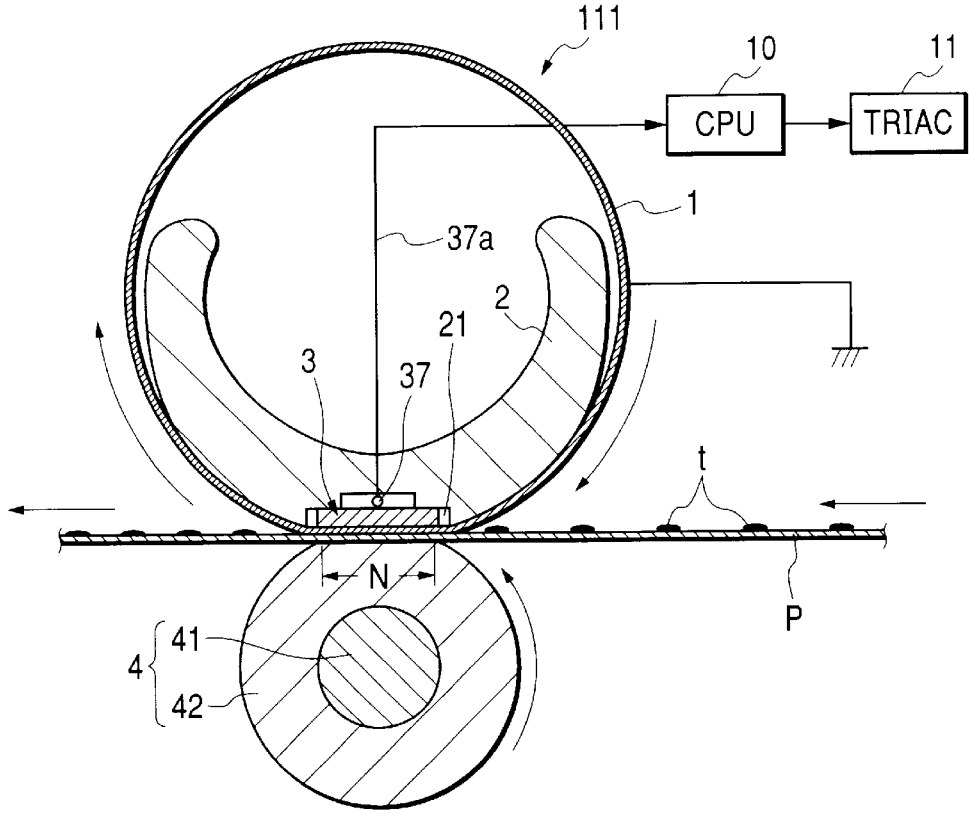
FIG. 2 is a cross-sectional view of the image heating apparatus of the present invention.
Figure 3:
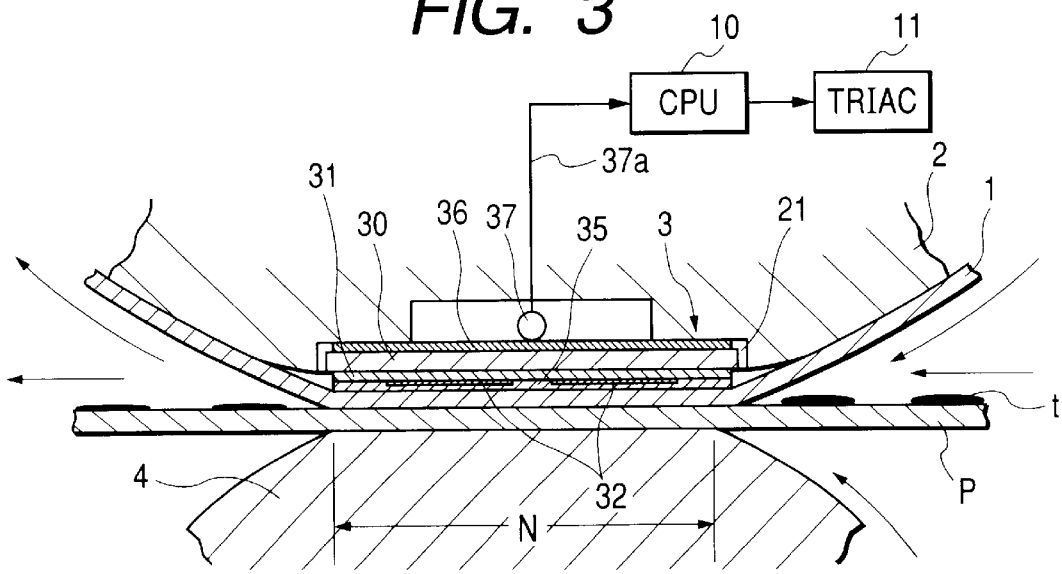
FIG. 3 is an enlarged cross-sectional view of the vicinity of the nip of the image heating apparatus of the present invention.

The heating and fixing apparatus 111 in the present embodiment is a heating apparatus using the film heating method of the pressure roller driving type and the tensionless type. FIG. 2 schematically shows the construction of the apparatus 111. FIG. 3 is a fragmentary enlarged model view of a fixing nip part.

The reference numeral 1 designates cylindrical (endless) thin heat-resistant film (fixing film), the reference numeral 2 denotes a heating member supporting member of a trough shape having a substantially semicircular transverse cross-section, the reference numeral 3 designates a metal heater which is a heating member supported by the heating member supporting member 2, and the reference numeral 4 denotes a pressure roller as a pressure member brought into pressure contact with the heater 3 with the film 1 interposed therebetween to thereby form a fixing nip part N.

The cylindrical film 1 is put onto the heating member supporting member 2 including the heater 3, and the inner peripheral length of the cylindrical film 1 is greater by e.g. 3 mm than the outer peripheral length of the heating member supporting member 2 including the heater 3, and accordingly the film 1 is loosely fitted on the heating member supporting member 2 with a surplus in the peripheral length thereof.

As the film 1, in order to make the heat capacity thereof small and improve the quick starting property, use can be made of single-layer film of heat-resistant PTFE, PFA or FEP having a film thickness of 100 $\mu$m or less, and preferably 50 $\mu$m or less and 20 $\mu$m or greater, or compound-layer film comprising polyimide, polyamide-imide, PEEK, PES, PPS or the like having its outer peripheral surface coated with PTFE, PFA, FEP or the like. In the present embodiment, use is made of compound-layer film comprising polyimide film having its outer peripheral surface coated with PTFE.

The heating member supporting member is a member of a trough shape having a substantially semicircular transverse cross-section and having an adiabatic property and rigidity. The underside of the heating member supporting member 2 is provided with an elongate shallow groove-shaped spot-faced portion 21 into which the heater 3 can be fitted along the length thereof, and the metal heater 3 is fitted in the spot-faced portion 21 and supported by the heating member supporting member 2. As the material of the heating member supporting member 2, use is made of heat-resistant resin such as PPS, liquid crystal polymer or phenol resin with glass added thereto to increase the strength thereof. Such resin is poured into a mold and used.

The heater 3 is a metal heater (conductive substrate heater) as a heating member according to the present invention, and more particularly an elongate, the plate-shaped member of generally low heat capacity having a direction perpendicular to the plane of the drawing sheet of FIG. 2 as its length. Although the structure of the heater 3 will be described in detail in item (3) below, the heater 3 quickly generates heat and rises in temperature by the supply of electric power to the heat generating resistance pattern thereof, and is temperature-controlled to a predetermined fixing temperature by a temperature control system. More particularly, the output of a thermistor 37 provided on the heating member 3 is A/D-converted and introduced into a control circuit (CPU) 10, and on the basis of the information thereof, pulse width modulation such as phase and wave number control is applied to an AC voltage supplied to the heat generating resistance pattern of the heater 3 by a triac 11 to thereby control the electric power supplied to the heater.

The pressure roller 4 comprises a metal core 41 and a heat-resistant rubber elastic layer 42 such as silicon rubber good in mold-releasing property and provided concentrically and integrally with the metal core, and the opposite end portions of the metal core 41 are rotatably supported between the chassis side plates, not shown, of the apparatus through bearings.

An assembly of the film 1, the heating member supporting member 2 and the heater 3 is opposed to and positioned on the upper side of the pressure roller 4 with the heater 3 side thereof facing downwardly, and a depressing force is caused to act on the heating member supporting member 2 by biasing means, not shown, whereby the downwardly facing surface of the heater 3 is brought into pressure contact with the upper surface of the pressure roller 4 with a predetermined pressure force against the elasticity of the rubber elastic layer 42 with the film 1 interposed therebetween. Thereby, a fixing nip part N of a predetermined width is formed between the heater 3 and the elastic pressure roller 4 with the film 1 interposed therebetween.

The pressure roller 4 is driven to rotate at a predetermined peripheral speed in a counter-clockwise direction by driving means, not shown. By the pressure contact frictional force in the fixing nip part N between the outer surface of the roller 4 and the outer surface of the film 1 by the rotation of the pressure roller 4, a rotational force acts on the cylindrical film 1, and the film 1 comes to rotate around the heating member supporting member 2 in the clockwise direction indicated by the arrow at a peripheral speed substantially corresponding to the rotational peripheral speed of the pressure roller 4 while the inner surface of the film 1 slides in close contact with the downwardly facing surface of the heater 3 in the fixing nip part N (the pressure roller driving system).

The heating member supporting member 2 also functions as a guide member for the rotating film 1. Also, a lubricant such as heat-resistant grease can be interposed between the downwardly facing surface of the heater 3 and the inner surface of the film 1 to thereby make the rotation of the film 1 smoother.

In a state in which the pressure roller 4 is driven to rotate and along therewith, the cylindrical film 1 comes to rotate, and as will be described later, electric power is supplied to the heater 3 and by the heat generation of the heater 3, the fixing nip part N rises and is controlled to a predetermined temperature, a recording material P bearing an unfixed toner image t thereon is introduced into between the film 1 and the pressure roller 4 in the fixing nip part N, and the recording material P is nipped and transported through the fixing nip part N with the toner image bearing surface thereof being in close contact with the outer surface of the film 1 in the fixing nip part N. In this process of being nipped and transported, the heat of the heater 3 is imparted to the recording material P through the film 1, and the unfixed toner image t on the recording material P is heated, fused and fixed. When it passes through the fixing nip part N, the recording material P self-strips from the outer surface of the rotating film 1 and is transported.

(3) Heater 3

Figures 4A, 4B, 4C:
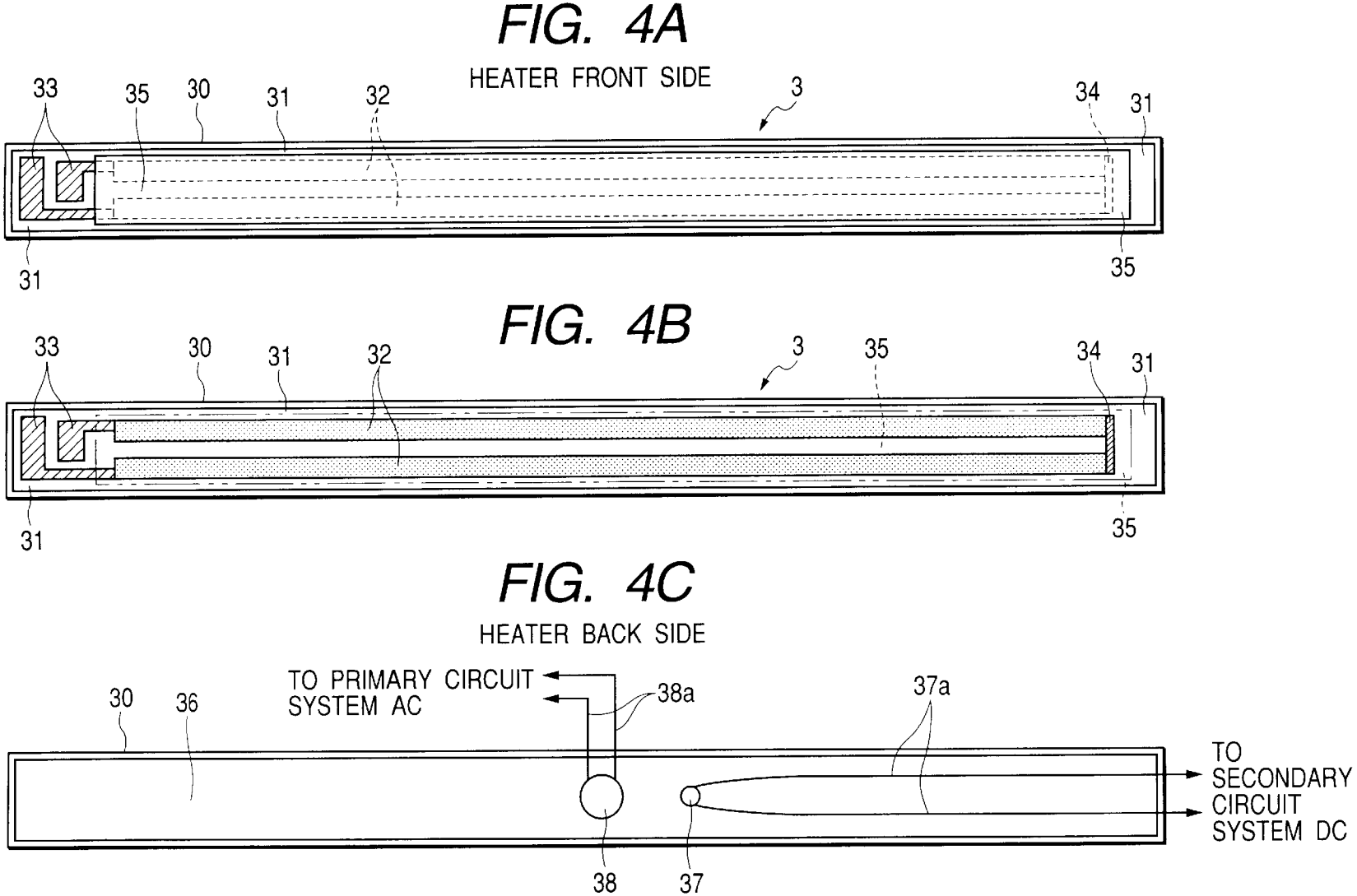
FIG. 4A shows the structure of the heater of the present invention when seen from the front side (image heating surface) thereof.
FIG. 4B shows a state in which an insulating layer 35 has been removed from the surface of the heater.
FIG. 4C shows the structure of the heater when seen from the back side (non-heating surface) thereof.

The heater 3 is a metal heater provided as a heating member according to the present invention, and FIG. 4A shows the front side of heater 3, FIG. 4B shows the heater 3 of FIG. 4A with a heat generating resistance pattern exposed except for a second insulating layer, and FIG. 4C shows the back side of the heater 3.

The heater 3 has a conductive substrate (electrically conductive substrate) 30, an insulating glass layer 31 as a first insulating layer formed on one side of the conductive substrate 30, two parallel heat generating resistance patterns 32 formed on the first insulating layer, two electric conductor patterns 33 as electric power supplying electrodes for supplying electric power to the heat generating resistance patterns, an electrically conducting pattern 34 as a turn-back electrode, an insulating glass layer 35 as a second insulating layer (surface insulating layer) formed so as to cover the heat generating resistance patterns 32, and an insulating glass layer 36 as a third insulating layer (surface insulating layer) formed on the other side which is the side opposite to the one side of the conductive substrate 30.

In the present embodiment, the second insulating layer 35 side of the heater 3 is the front side of the heater against which the back side of the film 1 abuts, and the third insulating layer 36 side is the back side of the heater. As shown in FIG. 3, the heater 3 is fitted in and supported by the spot-faced portion 21 of the heating member supporting member 2 with the second insulating layer 35 side which is the front side thereof exposed downwardly.

As the conductive substrate 30, use is made of a metal such as SUS 430 which is easy to adjust its coefficient of expansion to that of the glass layer as the insulating layer. The thickness of the substrate 30, in the present embodiment, is of the order of 0.5–0.6 mm. If the thickness of the substrate 30 is too small, warp becomes liable to occur due to the difference in coefficient of thermal expansion between the substrate and the insulating glass layer after printing and sintering, and the substrate becomes liable to bend and therefore, the handling thereof during the manufacturing process or the like becomes difficult. On the other hand, if the thickness of the substrate 30 is too great, the heat capacity of the substrate itself becomes great and therefore, the rise time of the heater is delayed and the control itself of temperature becomes difficult. This leads to the arising of image problems such as bad fixing, uneven luster and offset.

The insulating glass layer 31, serving as the first insulating layers, is formed on substantially the entire area of one side of the conductive substrate 30. The insulating glass layer 31 is formed by printing and applying, for example, a glass paste material onto the surface of the conductive substrate 30 by screen printing, and sintering it.

By forming the heat generating resistance patterns 32, the two electric conductor patterns 33 as the electric power supplying electrodes, and the electrically conducting pattern 34 as the turn-back electrode on the insulating glass layer 31, electrical insulation with respect to the conductor material 30 is secured.

The insulating glass layer 31 as the first insulating layer is formed with a thickness of 30 $\mu$m–100 $\mu$m to give it a withstand voltage of 1.5 kV or greater, and to prevent a pinhole, it is preferable to adopt a method of printing it a plurality of times. Also, in order to increase the adhesiveness of the conductive substrate 30 and the insulating glass layer 31, it is preferable to surface-roughen the conductive substrate 30 as by sand blast or etching, and decrease it, and thereafter print the insulating glass layer 31.

The electric power supplying heat generating resistance patterns 32 are formed by printing the paste of an electrical resistance material (a heat generating resistor or an electric power supplying heat generating resistor) such as Ag/Pd (silver palladium) into predetermined patterns as by screen printing, and sintering it.

Also, the electrically conducting patterns 33 and 34 are formed by printing the paste of a conductor such as Ag (silver) into predetermined patterns as by screen printing, and sintering it.

The insulating glass layer 35 as the second insulating layer covers the heat generating resistance patterns 32, the electrically conducting pattern 34 as the turn-back electrode, and a portion of the two electrically conducting patterns 33 as the electric power supplying electrodes and serves to protect them. The insulating glass layer 35 is formed by printing and applying, for example, a glass paste material onto the surface of the conductive substrate 30 by screen printing, and sintering it.

The insulating glass layer 36 as the third insulating layer is formed on the substantially whole area of the other side of the conductive substrate 30. The insulating glass layer 36 is formed by printing and applying, for example, a glass paste material onto the surface of the conductive substrate 30 by screen printing, and sintering it.

A thermistor 37 which is a temperature detecting element for controlling the supply of electric power to the heater is provided in abutting relationship with the insulating glass layer 36. The reference character 37*a* designates the lead wire of the thermistor 37 which is connected to the control circuit 10 (a secondary circuit system DC).

Also, a thermoswitch 38 as a safety device is disposed in contact with or in proximity to the insulating glass layer 36 as the third insulating layer. The reference character 38*a* denotes the lead wire of the thermoswitch 38. The thermoswitch 38 is connected in series to an electric power supplying circuit (a primary circuit system AC) to the heat generating resistance patterns 32 of the heater 3.

Electric power is supplied from the electric power supplying circuit (primary circuit system AC), not shown, to between the two electrically conducting patterns 33 as the electric power supplying electrodes of the heater 3, whereby the heat generating resistance patterns 32 generate heat over the full length thereof and the whole of the heater 3 quickly rises in temperature.

In the present embodiment, the thermistor 37 is a thermistor comprised of thermistor beads protected by glass to secure it and withstand voltage with respect to the conductive substrate 30 of the heater 3, and by measuring the resistance value of the thermistor beads, the temperature of the heater 3 is detected, and the electric power applied to the heat generating resistance patterns 32 of the heater is controlled to thereby control the temperature of the heater 3 to a predetermined temperature.

Also, besides the construction of the present embodiment, use may be made, for example, of a type in which a thermistor or a thermocouple is covered with an insulating protective sheet, or a type in which as the third insulating layer on the back of the heater, an electrically conducting pattern is formed on the insulating glass layer 36 and a chip type thermistor is mounted thereon, or there will be no problem even if a printed resistor is directly printed and formed.

Figure 5:
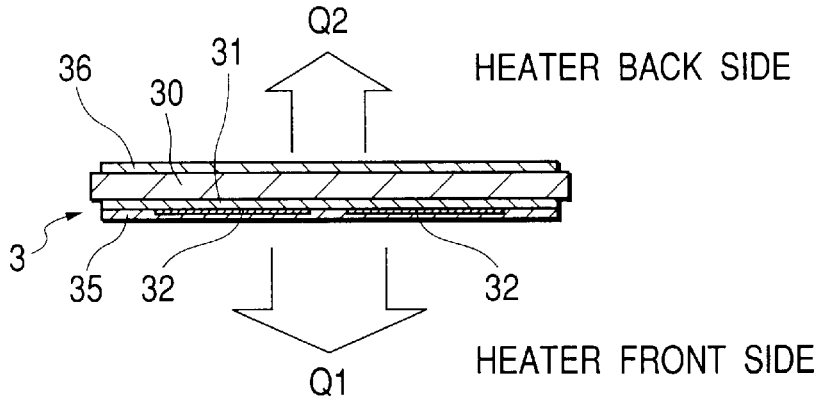
FIG. 5 is a cross-sectional view showing the heat conduction of the heater of the present invention.

Also, in the heater 3 of the present embodiment, when the heat conductivity of the first insulating glass layer 31 is defined as K1 and the heat conductivity of the second insulating glass layer 35 is defined as K2 and the heat conductivity of the third insulating glass layer 36 is defined as K3, these insulating glass layers are formed so that the relation among them may be K2>K3 (=K1). Specifically, the compositions, additives, etc. of the glass are adjusted so as to obtain desired heat conductivities, and in the present embodiment, they were adjusted so that the heat conductivity K2 of the second insulating glass layer 35 might be about 1.0–1.5 [W/(m·k)] (Watt per (meter·Kelvin)), and the heat conductivity K3 of the third insulating glass layer 36 and the heat conductivity K1 of the first insulating layer 31 might both be about 0.5–0.8 [W/(m·K)]. FIG. 5 is a typical view showing the relation of the heat conduction of the heater 3 used in the present embodiment. As described above, in the present embodiment, (the heat conductivity K2 of the second insulating layer 35)>(the heat conductivity K3 of the third insulating layer 36) and therefore, the heat transfer amount Q1 to the front side of the heater 3 can be made great relative to the heat transfer amount Q2 to the back side of the heater 3, and the heat transfer to the back side of the heater can be suppressed to the utmost and heat can be efficiently transferred to the front side of the heater and as the result, the quick rising of the heater is made possible and an improvement in the fixing property and the curtailment of electric power consumption become possible.

Figure 6:
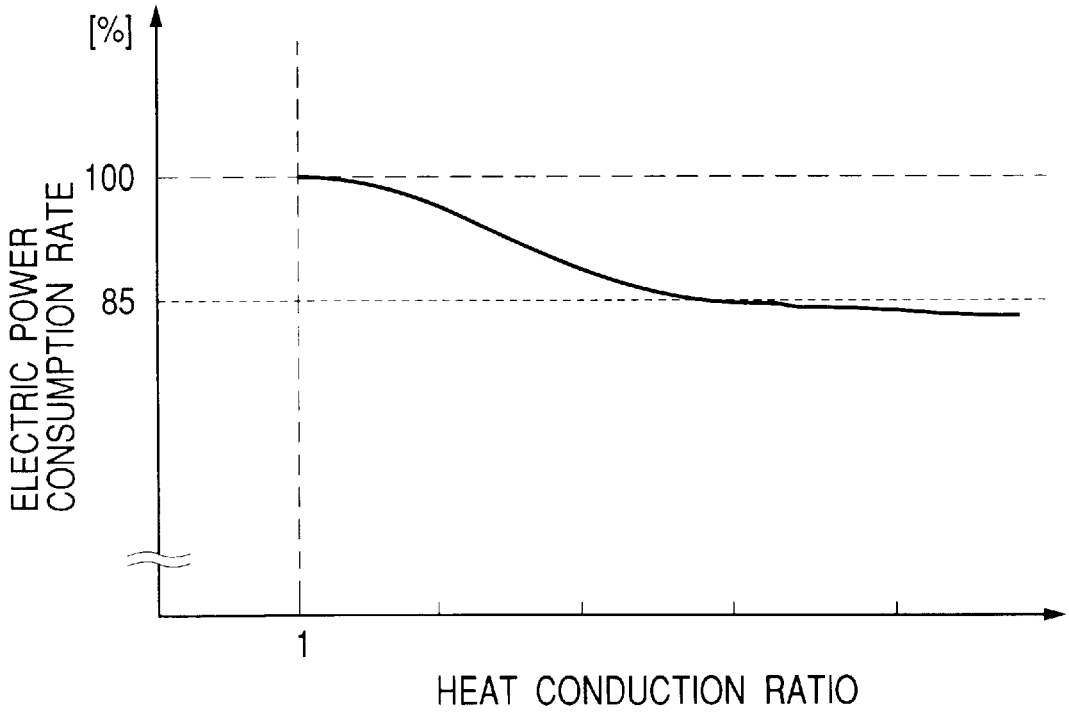
FIG. 6 shows the relation between the heat conduction ratio of the front side and back side of the heater and the electric power consumption.

It is FIG. 6 that shows the relation between the heat conduction ratio and electric power consumption at this time. FIG. 6 is a graph showing the relation of the electric power consumption to the heat conduction ratio K2/K3 between the heat conductivity K2 of the second insulating glass layer 35 which is the front side of the heater and the heat conductivity K3 of the third insulating glass layer 36 which is the back side of the heater, and shows the rate of the electric power consumption when the electric power consumption when the heat conduction ratio K2/K3=1 is 100%.

As will be seen from this result, by increasing the heat conduction ratio K2/K3, it is possible to curtail the electric power consumption.

Also, as a matter of course, the electric power consumption which can be curtailed changes also depending on the materials, shapes, etc. of the other constituents of the fixing apparatus than the heater, but in the construction of the present embodiment, the curtailment of 15–20% could be achieved.

As described above, in the present embodiment, use is made of a metal heater low in the cost of raw material and high in workability and by the adjustment of the heat conduction of the coat glass as the insulating layers on the front side and back side of the heater, the escape of heat to the heating member supporting member 2 can be suppressed to the utmost and at the same time, heat can be efficiently transferred to the front side of the heater and therefore, a heater which can achieve an improvement in the fixing property and further a reduction in the electric power consumption by a simpler construction can be realized at low costs.

Also, while the heater 3 in the above-described embodiment is of a type (front side heating type heater) in which the heat generating resistance patterns 32 are formed on the front side of the heater which is a surface opposed to the member to be heated, the present invention can also be applied to a heater (back side heating type heater) of a type in which the heat generating resistance patterns 32 are formed on the back side of the heater which is the side opposite to the side opposed to the member to be heated.

Figure 7A:
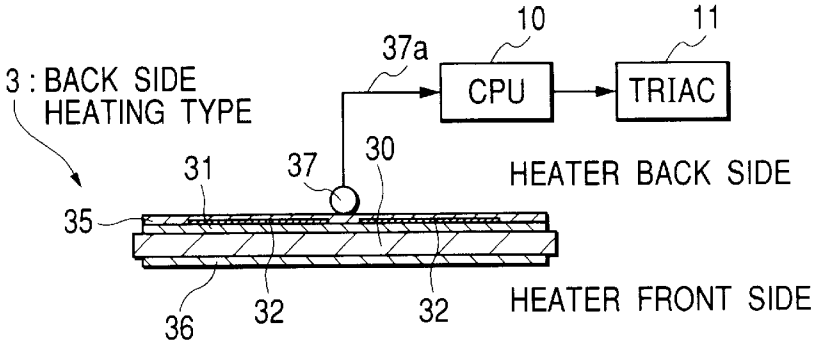
FIG. 7A is a cross-sectional view of the heater of the present invention when a heat generating resistance layer is present on the back side of the heater.
Figure 7B:
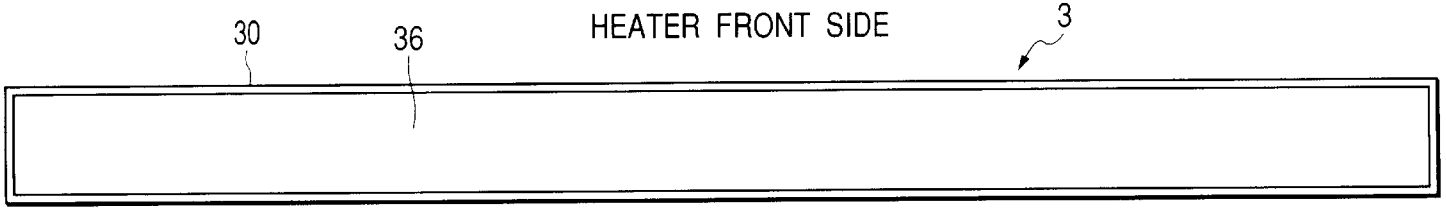
FIG. 7B is a view of the heater of FIG. 7A as it is seen from the front side thereof.
Figure 7C:
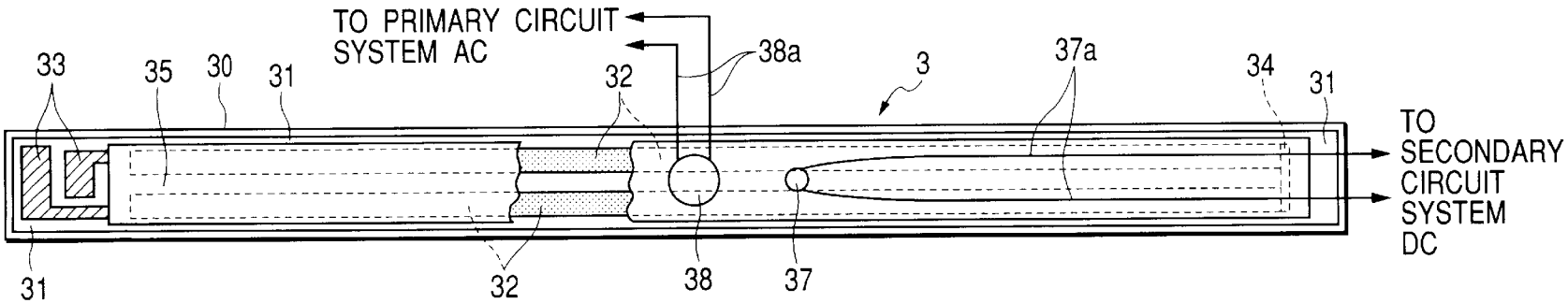
FIG. 7C is a view of the heater of FIG. 7A as it is seen from the back side thereof.

In the construction in this case, if the relation among the heat conductivity K1 of the first insulating glass layer 31, the heat conductivity K2 of the second insulating glass layer (surface insulating layer) 35 and the heat conductivity K3 of the third insulating glass layer (surface insulating layer) 36 is at least K3>K2, a similar effect will be obtained. FIG. 7A is a schematic cross-sectional view of the back side heating type heater, FIG. 7B shows the front side of the heater, and FIG. 7C shows the partly cut-away back side of the heater.

At this time, more preferably, the heat conductivity K1 of the first insulating glass layer 31, like that of the second insulating glass layer 35, may be in the relation that K1>K2.

In other words, with the heat generating resistance patterns 32 as the boundary, the heat conductivity of the insulating layer disposed on the surface side opposed to the member to be heated is made greater than the heat conductivity of the insulating layer disposed on the side opposite to the surface side opposed to the member to be heated, whereby it becomes possible to enhance heat efficiency, and an improvement in the fixing property and further a reduction in electric power consumption can be achieved.

[Second Embodiment]

In the embodiment, in the aforedescribed front side heating type metal heater 3 of FIGS. 3 and 4A–4C, the relation between the surface roughness Ra2 of the second insulating glass layer 35 which is the front side of the heater and the surface roughness Ra3 of the third insulating glass layer 36 which is the back side of the heater is formed so as to be Ra2<Ra3.

Specifically, in the heater used in the present embodiment, the surface roughness of the insulating glass layers is adjusted by changing the pattern and mesh of the screen when the glass coats are printed.

The surface roughness Ra2 of the insulating glass layer 35 on the front side of the heater may preferably be 0.1 $\mu$m in terms of Ra in order to enhance the close contact with the fixing film 1 and transfer heat efficiently, and in the present embodiment, the surface roughness Ra2 is of the order of 0.07–0.1 $\mu$m.

Also, it is preferable that the back side of the heater suppress the escape of heat to the heating member supporting member 2 supporting the heater 3, and the surface roughness of the insulating glass layer 36 on the back side of the heater is made great to thereby make the area of contact thereof with the supporting member 2 small, and a minute air layer is provided between the insulating glass layer 36 and the supporting member 2 to thereby obtain an adiabatic effect, whereby the escape of heat can be suppressed, and in the present embodiment, the surface roughness Ra3 of the insulating glass layer 36 on the back side of the heater is within the range of 0.5–2.0 $\mu$m.

The result of the comparison of the electric power consumption and necessary controlled temperature when a heater of the following construction was used is shown as an example.

When the relation between the surface roughness Ra2 of the insulating glass layer 35 which is the front side of the heater and the surface roughness Ra3 of the insulating glass layer 36 which is the back side of the heater is $$Ra2=Ra3\cong 0.1\ \mu\text{m}\ (REF),\ \text{and} \quad \text{(i)}$$

$$Ra2\cong 0.1\ \mu\text{m},\ Ra3\cong 1.0\ \mu\text{m}, \quad \text{(ii)}$$

when the electric power consumption and the controlled temperature when an equal fixing property was obtained were compared, the curtailment of electric power of about 10% was seen in the case (ii) relative to the electric power consumption in the case (i). Also, as the necessary lowest controlled temperature, it became possible to lower by about 10° C. when the construction of (ii) was used than in the case of the construction of (i).

As described above, the surface roughness of the insulating layer 36 on the back side of the heater is made great relative to the surface roughness of the insulating layer 35 on the front side of the heater, whereby the adiabatic effect in the portion of contact of the back side of the heater with the heating member supporting member 2 can be enhanced and the escape of heat can be suppressed and at the same time, the close contact property can be enhanced on the back side of the heater and heat can be efficiently transferred to the film 1 and the recording material P and therefore, a heater which can achieve an improvement in the fixing property and further a reduction in electric power consumption by a simpler construction can be realized at low costs.

Also, if in the aforedescribed back side heating type heater 3 of FIG. 7A, the relation between the surface roughness Ra2 of the second insulating glass layer 35 which is the back side of the heater and the surface roughness Ra3 of the third insulating glass layer 36 which is the front side of the heater as at least Ra2>Ra3, a similar effect will be obtained.

More preferably, the heat conductivity K1 of the first insulating glass layer 31, like that of the second insulating glass layer 35, may be in the relation that K1>K2.

[Third Embodiment]

In the embodiment, in the aforedescribed front side heating type metal heater 3 shown in FIGS. 3 and 4A–4C, the relation among the heat conductivity K3 of the third insulating layer 36 which is the back side of the heater, the heat conductivity K1 of the first insulating layer 31 which is the front side of the heater, and the heat conductivity K2 of the second insulating layer 35 is formed so as to be K2>K3 (=K1), and the relation between the surface roughness Ra2 of the second insulating layer 35 and the surface roughness Ra3 of the third insulating layer 36 is formed so as to be Ra2<Ra3.

Thereby, the effect of the first embodiment and the effect of the second embodiment are combined together, whereby a heater in which heat can be more efficiently transferred to the front side and further, the quick starting property can be improved and an improvement in the fixing property can be achieved and still further, a reduction in electric power consumption can be achieved can be realized at lower costs.

[Fourth Embodiment]

An embodiment in which the responsiveness of the thermistor can be improved will now be described.

Figures 9A, 9B, 9C:
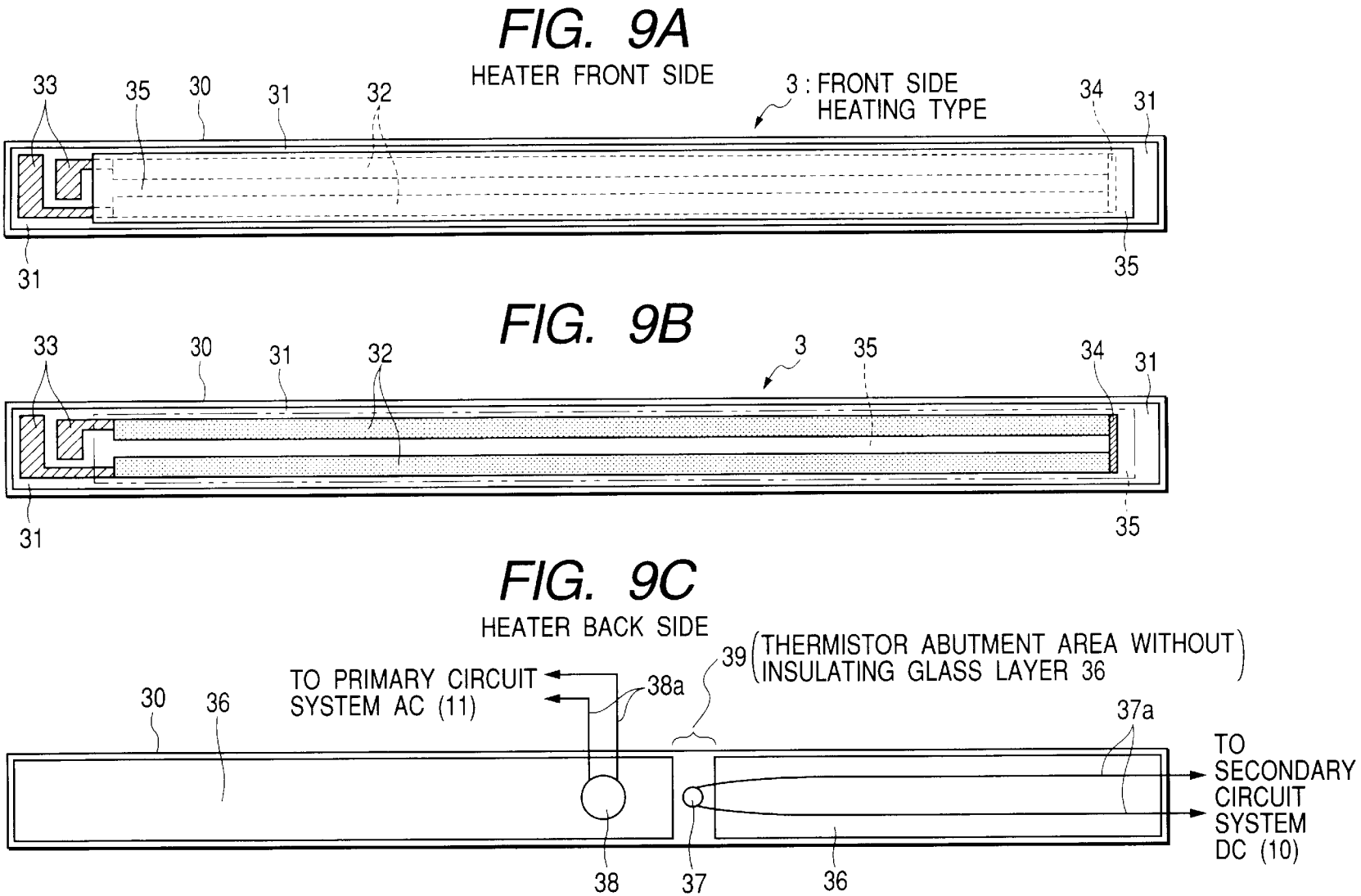
FIG. 9A shows the structure of the heater of FIG. 8 when seen from the front side (image heating surface) thereof.
FIG. 9B shows a state in which an insulating layer 36 has been removed from the front side of the heater.
FIG. 9C shows the structure of the heater when seen from the back side (non-heating surface) thereof.

The heater 3 is a metal heater as a heating member according to the present invention, and FIG. 9A is a plan view of the front side of the heater 3, FIG. 9B is a plan view showing heat generating resistance patterns exposed except a second insulating layer in FIG. 9A, and FIG. 9C is a plan view of the back side of the heater 3.

The heater 3 has a conductive substrate (electrically conductive substrate) 30, an insulating glass layer 31 as a first insulating layer formed on one side (first side) of the conductive substrate 30, two parallel heat generating resistance patterns 32 formed on the first insulating layer, two electric conductor patterns 33 as electric power supplying electrodes for supplying electric power to the heat generating resistance patterns, an electrically conducting pattern 34 as a turn-back electrode, an insulating glass layer 35 as a second insulating layer (surface insulating layer) formed so as to cover the heat generating resistance patterns 32, and an insulating glass layer 36 as a third insulating layer (surface insulating layer) formed on the other side (second side) which is the side opposite to the one side of the conductive substrate 30.

Figure 8:
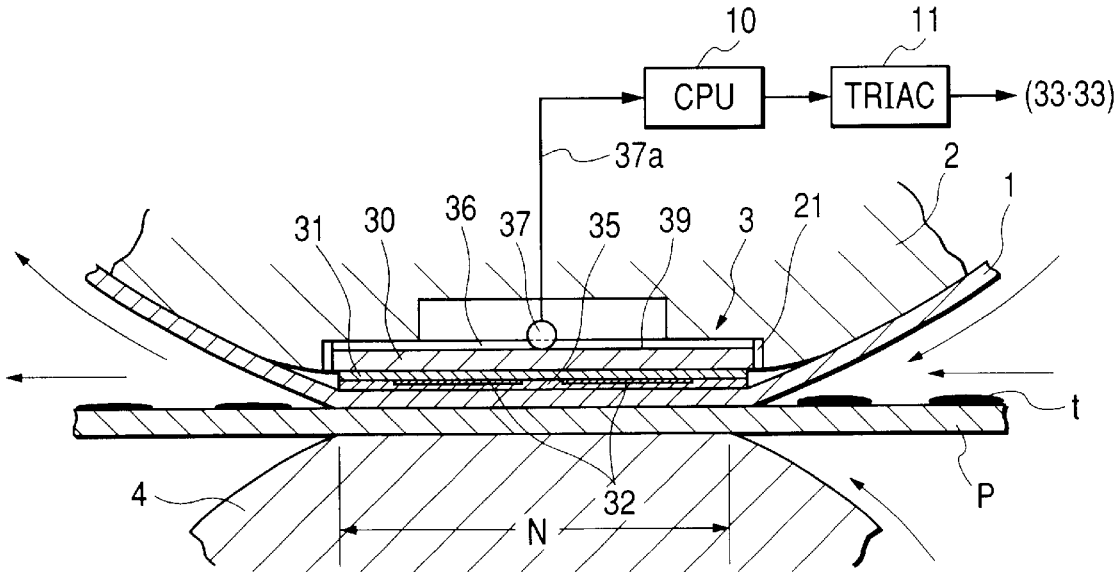
FIG. 8 is a cross-sectional view of the vicinity of the nip of an image heating apparatus using a heater in which a surface insulating layer is absent on the thermistor abutting area of the back side of the heater and a surface insulating layer is provided around it.

The heater 3 of the present embodiment is of the "front side heating type", and the second insulating layer 35 side is the front side of the heater which abuts against the back of the film 1, and the third insulating layer 36 side is the back side of the heater. As shown in FIG. 8, the heater 3 is fitted in and supported by the spot-faced portion 21 of the heating member supporting member 2 with the second insulating layer 35 side which is the front side thereof being downwardly exposed.

As the conductive substrate 30, use is made of a metal such as SUS 430 which is easy to adjust to the coefficient of expansion of the glass layers 31, 35 and 36 as the insulating layers. The thickness of the substrate 30, in the present embodiment, is of the order of 0.4–0.6 mm. If the thickness of the substrate 30 is too small, warp becomes liable to occur due to the difference in coefficient of thermal expansion between the substrate and the insulating glass layers after printing and sintering, and they become liable to bend and therefore, the handling thereof during the manufacturing process or the like becomes difficult. On the other hand, if the thickness of the substrate 30 is too great, the heat capacity of the substrate itself becomes great and therefore, the rise time of the heater is delayed and the control itself of temperature becomes difficult. This also leads to the arising of problems such as bad fixing, uneven luster and offset.

The insulating glass layer 31 serving as the first insulating layer is formed on substantially the entire area of one side of the conductive substrate 30. The insulating glass layer 31 is formed by printing and applying, for example, a glass paste material onto the surface of the conductive substrate 30 by screen printing, and sintering it.

The heat generating resistance patterns 32, the two electric conductor patterns 33 as the electric power supplying electrodes, and the electrically conducting pattern 34 as the turn-back electrode are formed on the insulating glass layer 31, whereby the electrical insulation thereof with respect to the conductive substrate 30 is secured.

The insulating glass layer 31 as the first insulating layer is formed with a thickness of 30 $\mu$m–100 $\mu$m to give it a withstand voltage of 1.5 kV or greater, and it is preferable to adopt a method of printing it a plurality of times to a prevent pinhole. Also, in order to increase the adhesiveness of the conductive substrate 30 and the insulating glass layer 31, it is preferable to roughen the conductive substrate 30 as by sand blast or etching, and degrease it, and thereafter print the insulating glass layer 31.

The electric power supplying heat generating resistance patterns 32 are formed by printing the paste of an electrical resistance material (a heat generating resistor or an electric power supplying heat generating resistor) such as Ag/Pd (silver palladium) into predetermined patterns by screen printing or the like, and sintering it.

Also, the electrically conducting patterns 33 and 34 are formed by printing the paste of an electric conductor such as Ag (silver) into predetermined patterns by screen printing or the like, and sintering it.

The insulating glass layer 35 as the second insulating layer serves as a heater surface protecting layer covering portions of the heat generating resistance patterns 32, the electrically conducting pattern 34 as the turn-back electrode, and the two electrically conducting patterns 33 as the electric power supplying electrodes, and protecting them. The insulating glass layer 35 is formed by printing and applying, for example, a glass paste material onto the surface of the conductive substrate 30 by screen printing, and sintering it.

The insulating glass layer 36 as the third insulating layer is made to function as the back side adiabatic layer of the heater 3, and is formed on the substantially entire area of the other side of the conductive substrate 30 except the abutment area 39 of a thermistor 37 which is a temperature detecting element for controlling the supply of electric power to the heater. The insulating glass layer 36 is formed by printing and applying, for example, a glass paste material onto the surface of the conductive substrate 30 by screen printing, and sintering it.

The thermistor 37 is disposed in direct abutting relationship with the surface of the conductive substrate 30 in the abutment area 39 wherein the insulating glass layer 36 is absent on the back side of the heater. The thermistor 37 is connected to a control circuit 10 through a lead wire 37*a* (secondary circuit system DC).

Also, a thermoswitch 38 as a safety device is disposed in contact with or in proximity to the insulating glass layer 36 as the third insulating layer. The reference character 38*a* designates the lead wire of the thermoswitch 38. The thermoswitch 38 is connected in series to an electric power supplying circuit (primary circuit system AC), i.e., a triac 11, to the heat generating resistance patterns 32 of the heater 3.

Electric power supply is done from the triac 11 to between the two electrically conducting patterns 33 as the electric power supplying electrodes of the heater 3, whereby the heat generating resistance patterns 32 generate heat over the full lengths thereof and the whole of the heater 3 quickly rises in temperature.

In the present embodiment, the thermistor 37 is a thermistor comprised of thermistor beads protected by glass to secure the insulating withstand voltage with the conductive substrate of the heater 3, and measures the resistance value of the thermistor beads to thereby detect the temperature of the heater 3, and controls the electric power applied to the heat generating resistance patterns 32 of the heater 3 to thereby control the temperature of the heater 3 to a predetermined temperature.

Also, besides the construction of the present embodiment, use may be made of one of a type in which the thermistor or the thermocouple is covered with an insulating protective sheet.

Usually, the heat conductivity of SUS 430 used as the conductive substrate is better by about a figure than the heat conductivities of the glass layers used as the insulating layers and therefore, the magnitude relation between the heat conductivities of the respective glass layers is not particularly limited, but a sufficient adiabatic effect is obtained simply by disposing an insulating glass layer on the back of the conductive substrate, but in order to more efficiently transfer heat to the front side of the substrate and enhance the adiabatic effect of the back side thereof, in the heater 3 of the present embodiment, design is made such that when the heat conductivity of the first insulating glass layer 31 is defined K1 and the heat conductivity of the second insulating glass layer 35 is defined as K2 and the heat conductivity of the third insulating glass layer 36 is defined as K3, the relation among them is K2>K3 (=K1).

The heat conductivity of each insulating glass layer is specifically adjusted to a desired rate by adjusting the compositions, additives, etc. of the glass, and in the present embodiment, as the second insulating glass layer 35, use is made of one in which the heat conductivity K2 is about 1.1–1.5 [W/(m·K)], and as the third and first insulating glass layers 36 and 31, use is made of ones in which the heat conductivities K3 and K1 are about 0.8–1.0 [W/(m·K)]. Also, as the conductive substrate 30, use is made of one in which the heat conductivity is about 20–30 [W/(m·K)].

Figure 10B:
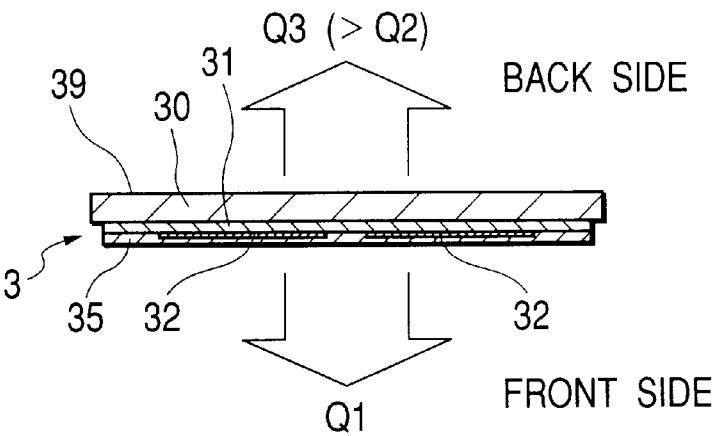
FIG. 10B shows the heat conduction of that area (thermistor abutment area) of the heater of FIG. 8 in the lengthwise direction thereof in which the surface insulating layer 36 is absent.
Figure 10A:
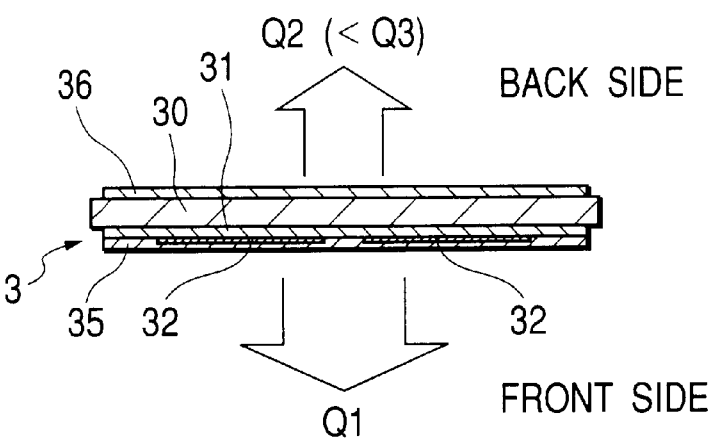
FIG. 10A shows the heat conduction of that area of the heater of FIG. 8 in the lengthwise direction thereof in which the surface insulating layer 36 is present.

FIG. 10A is a transverse cross-sectional model view of the heater 3 in the portion thereof wherein the third insulating glass layer 36 which is the back side adiabatic layer of the heater is present, and FIG. 10B is a transverse cross-sectional model view of the heater in the abutment area 39 of the thermistor 37 which is a portion in which the third insulating glass layer 36 is absent, and these figures typically represent the states of the heat transfer Q1 to the front side and the heat transfers Q2 and Q3 of the back side in the respective portions of the heater.

That is, it will be seen that in the heater 3, the heat conductivities of the insulating glass layers differ by about one figure relative to the heat conductivity of the conductive substrate 30, whereby the front side heating type heater 3 of the present embodiment is made to about against the heating member supporting member 2 through the third insulating glass layer 36 functioning as the adiabatic layer on the back side, whereby it becomes possible to suppress the heat transfer to the heating member supporting member 2 by the adiabatic effect and it becomes possible to heat the heater 3 efficiently and at the same time, the thermistor 37 which is a temperature detecting element is disposed in directly abutting relationship with the surface of the conductive substrate 30 in the abutment area 39 without the insulating glass layer 36 on the back side of the heater, whereby the heat transfer Q3 to the thermistor 37 can be made great relative to Q2, and temperature control can be done more accurately.

Figure 11:
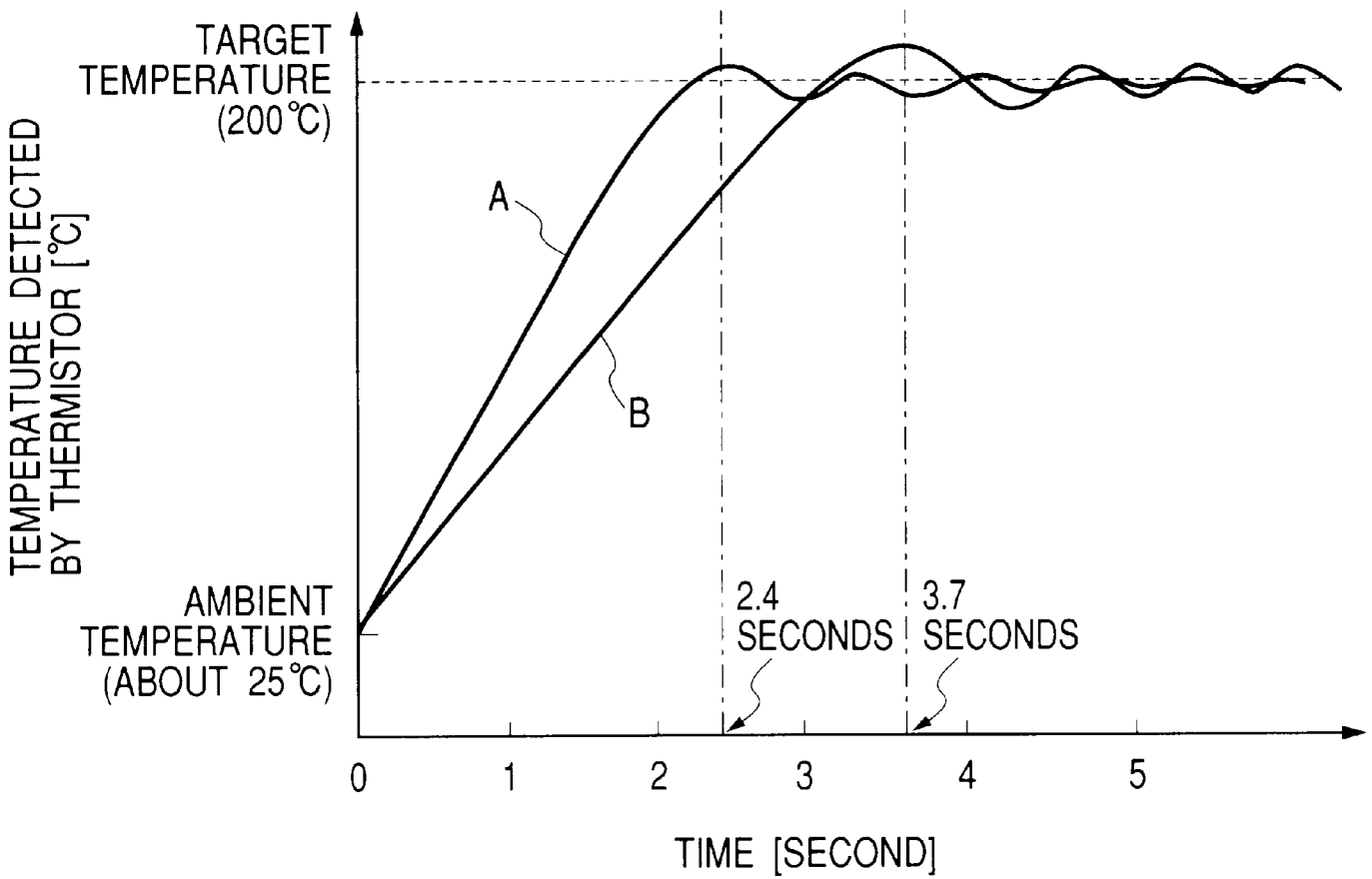
FIG. 11 shows the responsiveness of the thermistor when it detects temperature without the intermediary of the surface insulating layer (A) and when it detects temperature through the intermediary of the surface insulating layer (B).

FIG. 11 shows the comparison between the outputs of the detected temperatures by the thermistor in a case A where, as in the present embodiment, the thermistor 37 which is a temperature detecting element is disposed in directly abutting relationship with the surface of the conductive substrate 30 in the abutment area 39 without the insulating glass layer 36 on the back side of the heater, and a case B where as a comparative example, the insulating glass layer 36 is formed on the entire area of the back side of the heater and the thermistor 37 which is a temperature detecting element is disposed in abutting relationship with the insulating glass layer 36, and from this, it will be seen that the detected temperatures apparently differ in rise time and responsiveness from each other.

In the experiment, the comparison of the rise time and responsiveness was made under the same conditions (input electric power: 1000 W; target controlled temperature: 200° C.; process speed: 150 mm/sec.).

In the case of this experiment, the rise time was about 3.7 seconds in the case B of the comparative example, whereas it was 2.4 seconds in the case A of the present embodiment, and it will be seen that the thermistor detection speed apparently becomes better.

As described above, the insulating glass layer 36 is formed in the other abutment area of the heating member supporting member than the thermistor abutment area 39 and the insulating glass layer is not formed only in the thermistor abutment area 39, whereby the heat transfer from the heater 3 to the heating member supporting member 2 can be suppressed to the utmost and at the same time, the insulating glass layer 36 hampering heat transfer is not formed only in the thermistor abutment area 39, whereby the temperature of the heater 3 can be detected and controlled more accurately and therefore, it becomes possible to suppress electric power consumption and at the same time, control suffering little from temperature ripple becomes possible by accurate temperature control, and it becomes possible to suppress bad images such as offset.

[Fifth Embodiment]

Figure 12:
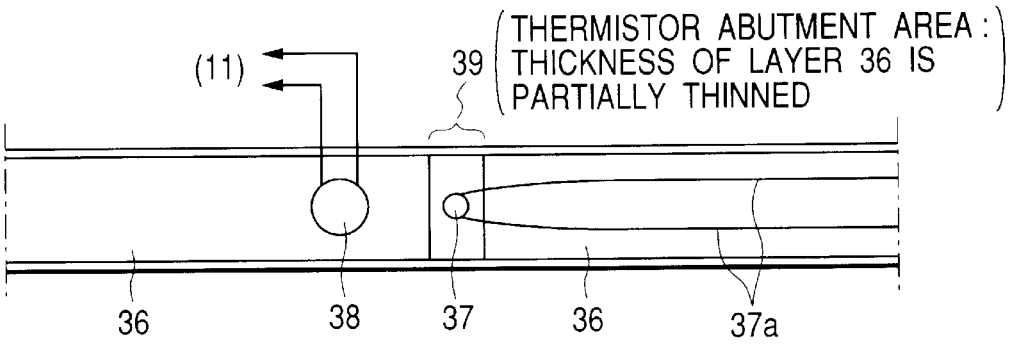
FIG. 12 is a view of a heater in which the thickness of the surface insulating layer in the thermistor abutment area is made small as it is seen from the back side thereof.

FIG. 12 is a model view of the essential portions of the embodiment. The present embodiment is such that in the front side heating type heater 3 in the fourth embodiment, the third insulating glass layer 36 is formed on the entire area of the back side of the heater, but the thickness of that portion of the insulating glass layer 36 which corresponds to the thermistor abutment area 39 is made smaller than the thickness of the insulating glass layer 36 in the other portions.

For example, in the present embodiment, the thickness of the insulating glass layer 36 which is the adiabatic layer on the back of the heater 3 is about 80–100 $\mu$m in order to give it a sufficient adiabatic effect, but in the present embodiment, the layer 36 is formed by three layers to uniformly form the insulating glass layer. So, in the thermistor abutment area 39, one or two insulating glass layers are formed, whereafter for example, the thermistor abutment area 39 is masked and further, an insulating glass layer is formed on the entire area of the heater.

By doing so, only the glass coat of the thermistor abutment area 39 can be simply formed thinly.

By forming the insulating glass layer 36 thinly only on the thermistor abutment area 39 as described above, the adiabatic effect is achieved and at the same time, it becomes unnecessary to give insulativeness to the construction of the thermistor itself and therefore, the construction of the thermistor 37 can be designed more freely and at the same time, by improving the heat capacity and heat conductivity of the thermistor itself, sufficient responsiveness becomes obtainable.

In the case of the construction of the present embodiment, the temperature detecting element may be one in which an electrically conducting pattern is printed and formed and a chip type thermistor is mounted thereon, and there will be no problem even if a print resistor is directly printed and formed.

[Sixth Embodiment]

Figure 13:
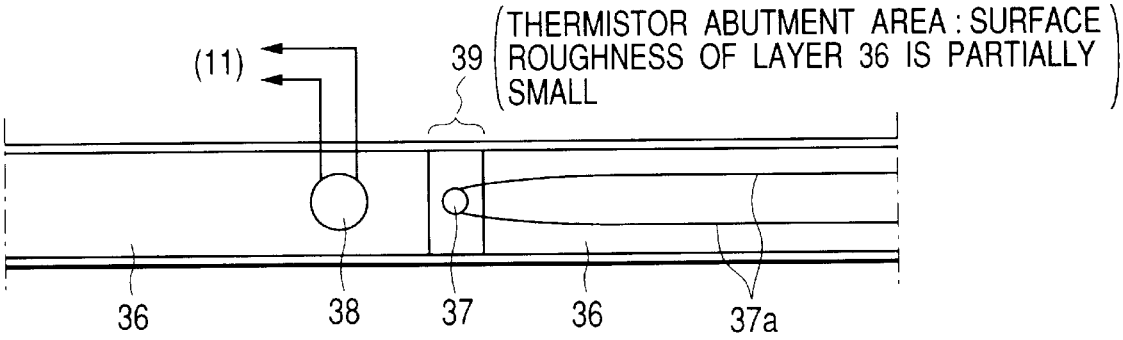
FIG. 13 is a view of a heater in which the surface roughness of the surface insulating layer in the thermistor abutment area is made small as it is seen from the back side thereof.

FIG. 13 is a model view of the essential portions of the embodiment. The present embodiment is such that in the front side heating type heater 3 in the fourth embodiment, the third insulating glass layer 36 as an adiabatic layer is formed on the entire area of the back side of the heater, but the surface roughness of that portion of the insulating glass layer 36 which corresponds to the thermistor abutment area 39 is made smaller than the surface roughness of the insulating glass layer 36 in the other portions.

Specifically, when printing and forming the insulating glass layer 36, the mesh of the screen is adjusted to thereby adjust the surface roughness of the thermistor abutment area 39 of the insulating glass layer 36 and the other areas than the abutment area 39, and the thermistor abutment area 39 is made small in surface area, and in the other areas, surface roughness is made great.

In the case of the present embodiment, in the thermistor abutment area 39, the surface roughness Ra is formed so as to be about 0.07–0.1 $\mu$m, whereas in the other entire area than the thermistor abutment area 39, the surface roughness Ra is formed so as to be about 0.5–2.0 $\mu$m.

Thereby, the contact heat resistance of the thermistor 37 in the thermistor abutment area 39 can be made small and the close contact property can be enhanced to thereby detect a more accurate temperature, and at the same time, the glass surface roughness of the other areas than the thermistor abutment area is made great to thereby make the area of contact between the heater 3 and the heating member supporting member 2 small, whereby it becomes possible to enhance the adiabatic effect.

By adopting the present construction as described above, an excellent adiabatic property is obtained and the heat transfer from the heater 3 to the heating member supporting member 2 can be suppressed to the utmost and at the same time, by an excellent heater construction, heat transfer can be bettered only in the thermistor abutment area 39 and therefore, the responsiveness of the thermistor can be improved and the temperature of the heater 3 can be detected and controlled more accurately and thus, it becomes possible to suppress electric power consumption and at the same time, control suffering little from temperature ripples becomes possible by accurate temperature control, and it becomes possible to suppress bad images such as offset.

[Seventh Embodiment]

Figure 14:
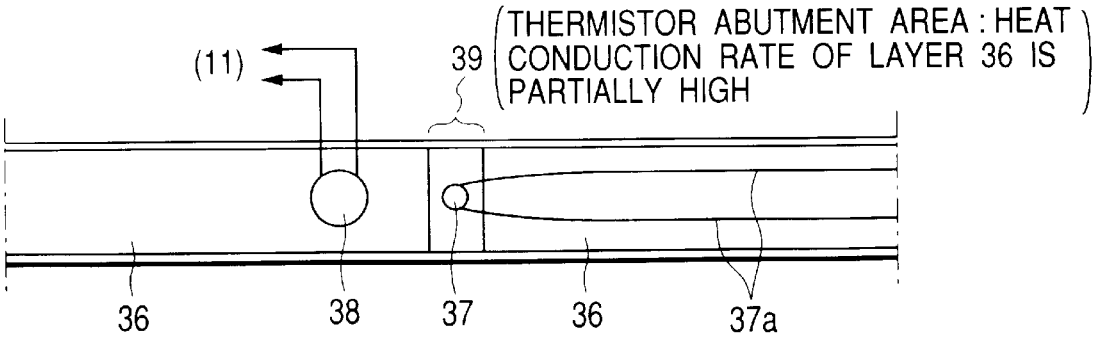
FIG. 14 is a view of a heater in which the surface insulating layer in the thermistor abutment area is formed of a material higher in heat conduction than the surface insulating layer around it as it is seen from the back side thereof.

FIG. 14 is a model view of the essential portions of the embodiment. The present embodiment is such that in the front side heating type heater 3 in the fourth embodiment, the third insulating glass layer 36 as an adiabatic layer is formed on the entire area of the back side of the heater, but the heat conductivity of that portion of the insulating glass layer 36 which corresponds to the thermistor abutment area 39 is made higher than the heat conductivity of the insulating glass layer 36 in the other portions.

In the present embodiment, high heat conductivity glass is printed and formed on the thermistor abutment area 39, and next, on the other areas than the thermistor abutment area 39, glass of a type which is lower in heat conductivity than the high heat conductivity glass used in the thermistor abutment area is printed and formed.

Specifically, glass having a heat conductivity of about 0.8 [W/(m·K)] is used in the thermistor abutment area 39, and glass having a heat conductivity of about 1.3–1.5 [W/(m·K)] is used in the other areas than the thermistor abutment area.

As described above, the high heat conductivity insulating glass layer is formed only on the thermistor abutment area 39, and the insulating glass layer low in heat conductivity is formed on the other areas than the thermistor abutment area, whereby the heat conductivity of the thermistor portion can be enhanced and a more accurate temperature can be detected and at the same time, the heat conductivity of the insulating glass layer in the other portions than the thermistor portion is lowered, whereby it becomes possible to suppress the escape of heat from the heater 3 to the heating member supporting member 2, and heat efficiency is improved and electric power consumption is suppressed and at the same time, control suffering little from temperature ripple becomes possible by accurate temperature control, and it becomes possible to suppress bad images such as offset.

[Eighth Embodiment]

Figure 15A:
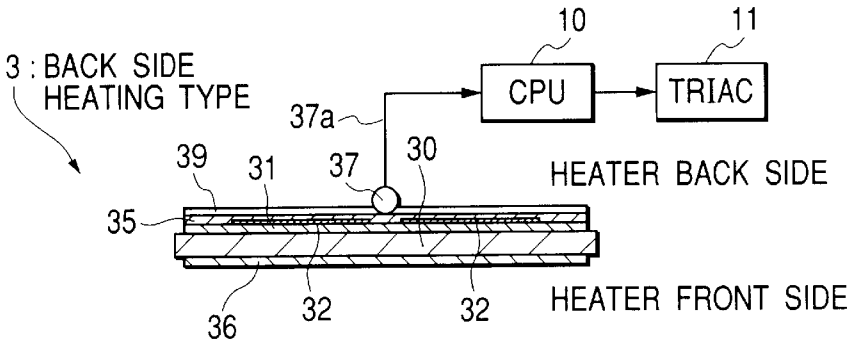
FIG. 15A is a cross-sectional view of a heater having a heat generating resistance layer provided on the back side thereof and in which the surface insulating layer in the thermistor abutment area is made thinner than that around it.
Figure 15B:
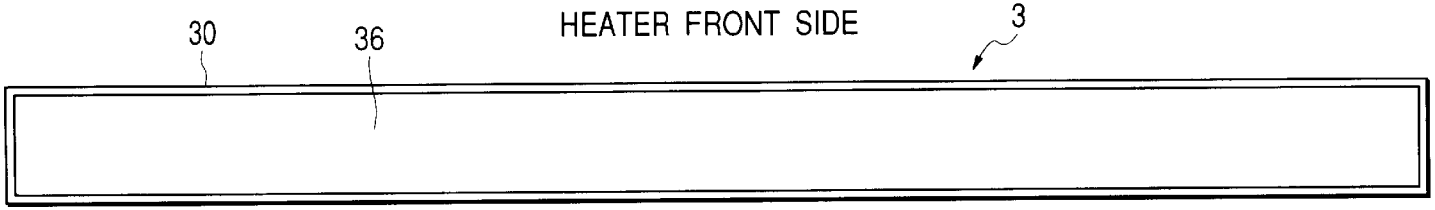
FIG. 15B is a view of the heater when seen from the front side (image heating surface) thereof.
Figure 15C:
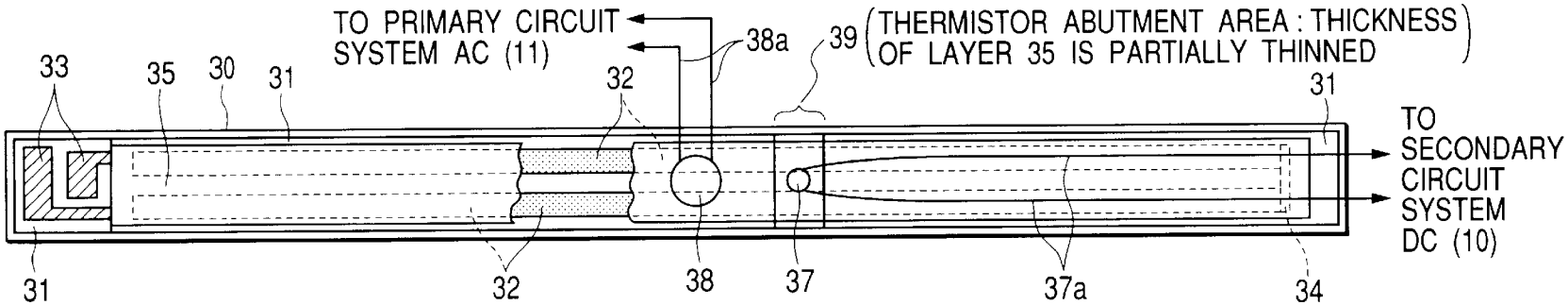
FIG. 15C is a view of the heater when seen from the back side (non-heating surface) thereof.

The embodiment is an example of the "back side heating type" heater, and FIG. 15A is a transverse cross-sectional model view thereof, FIG. 15B is a plan view of the front side thereof, and FIG. 15C is a plan view of the back side thereof. The heater 3 is such that the third insulating glass layer 36 side of the front side heating type heater 3 of the fourth embodiment is the front side of the heating member which is opposed to a member to be heated.

In the case of the back side heating type heater 3, the third insulating glass layer 36 is made to function as the front side protecting layer of the heater 3, and the second insulating glass layer 35 which is the back side of the heater is made to function as an adiabatic layer for suppressing the escape of heat to the heating member supporting member 2, etc. to the utmost. Also, as the first insulating glass layer 31, use may preferably be made of a high heat conduction type one to transfer the heat of the heat generating member efficiently to the substrate side, and in the present embodiment, it is preferable to form the magnitude relation of the heat conductivities so as to be K3=K1>K2. In the case of the back side heating type heater 3, the second insulating glass layer 35 is formed thinly only in the thermistor abutment area 39 in a manner similar to the manner of forming the third insulating glass layer 36 in the thermistor abutment area 39 in the aforedescribed fifth embodiment.

When the present construction is adopted, the positions of the heat generating resistors 32 and the thermistor 37 become close to each other and therefore, the temperature of the heater can be detected and controlled more accurately and proper temperature control becomes possible.

[Ninth Embodiment]

Figure 16:
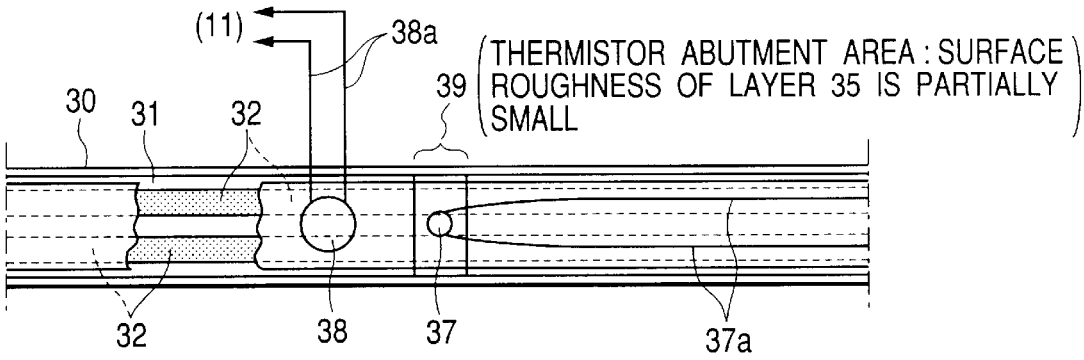
FIG. 16 is a view of a heater having a heat generating resistance layer provided on the back side thereof and in which the surface roughness of the surface insulating layer in the thermistor abutment area is made small as it is seen from the back side thereof.

FIG. 16 is a model view of the essential portions of the embodiment. The present embodiment is such that in the back side heating type heater 3 in the eighth embodiment, when the second insulating glass layer 35 as a heater back adiabatic layer is to be formed, only in the thermistor abutment area 39, the surface roughness is made smaller than the surface roughness of the insulating glass layer 35 in the other portions in a manner similar to the manner of forming the thermistor abutment area 39 of the third insulating glass layer 36 in the aforedescribed sixth embodiment.

When the present construction is adopted, the positions of the heat generating resistors 32 and the thermistor 37 become close to each other and therefore, the temperature of the heater 3 can be detected more accurately and proper temperature control becomes possible, whereby control suffering less from temperature ripple becomes possible, and it becomes possible to suppress bad images such as offset.

[Tenth Embodiment]

Figure 17:
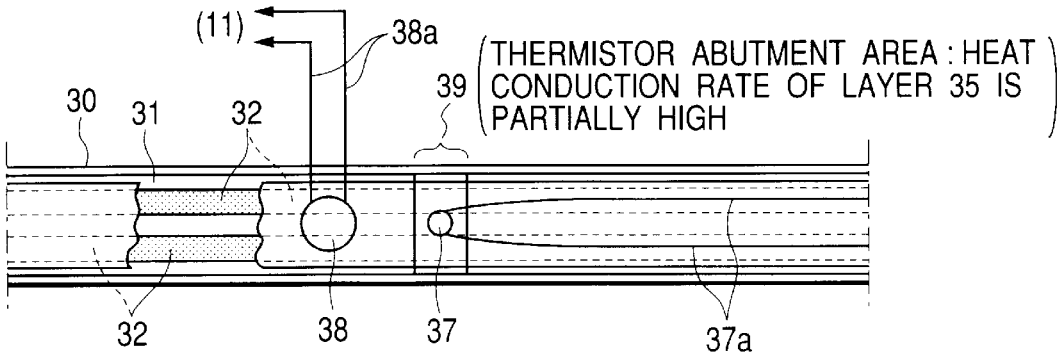
FIG. 17 is a view of a heater having a heat generating resistance layer provided on the back side thereof and in which the surface insulating layer in the thermistor abutment area is formed of a material higher in heat conduction than the surface insulating layer around it as it is seen from the back side thereof.

FIG. 17 is a model view of the essential portions of the embodiment. The present embodiment is such that in the back side heating type heater 3 in the eighth embodiment, when the second insulating glass layer 35 as a heater back adiabatic layer is to be formed, only in the thermistor abutment area 39, the heat conductivity is made higher than the heat conductivity of the insulating glass layer 36 in the other portions in a manner similar to the manner of forming the thermistor abutment area 39 of the third insulating glass layer 36 in the aforedescribed seventh embodiment.

When the present construction is adopted, the positions of the heat generating resistors 32 and the thermistor 37 become close to each other and therefore, the temperature of the heater 3 can be detected more accurately and proper temperature control becomes possible, whereby control suffering less from temperature ripple becomes possible, and it becomes possible to suppress bad images such as offset.

[Others]

1) Regarding the abutment area of the thermoswitch 38 as a safety device disposed in contact with or in proximity to the heater 3, disposition and construction similar to those of the aforedescribed thermistor abutment area 39 can be adopted.

2) In the heating apparatus of the film heating type, there can also be adopted an apparatus construction in which endless belt-shaped film is wound and stretched with tension imparted thereto, and is rotatively driven. Also, there can be adopted an apparatus construction in which long rolled film is used and is moved at a predetermined speed from a pay-away spool side to a take-up spool side via the heater.

3) Of course, the heating member of the present invention can be applied not only to the heating apparatus of the film heating type, but a heating apparatus in which a heating member supported by a heating member supporting member is brought into direct contact with the member to be heated to thereby heat the latter, etc.

4) The heating apparatus of the present invention can of course be widely used not only as an image heating and fixing apparatus, but also, for example, as an image heating apparatus for heating a recording material bearing an image thereon and improving the surface properties thereof such as luster, an image heating apparatus for tentatively fixing an image, a heating apparatus for feeding sheet-shaped articles and subjecting them to the drying process, the laminating process, the smoothing hot press process, etc., a heater used in a heating apparatus for drying used in an ink jet printer or the like, or a heating apparatus using such heater, or the like.

The present invention is not restricted to the above-described embodiments, but also covers modifications identical therewith in technical idea.

What is claimed is:

1. An image heating apparatus for heating an image formed on a recording material, comprising:

a heater including a heat generating resistor, an electrically conductive substrate, an intermediate insulating layer formed between said resistor and said substrate and two surface insulating layers provided respectively on substantially entire areas of both surface sides of said substrate;

wherein a surface insulating layer on a surface side of said substrate which is opposed to the recording material is higher in heat conductivity than a surface insulating layer on an opposite surface side.

2. An image heating apparatus according to claim 1, wherein a heat conductivity of said intermediate insulating layer between said resistor and said substrate is the same as a heat conductivity of said surface insulating layer on the opposite surface side opposite to the surface side of said substrate which is opposed to the recording material.

3. An image heating apparatus according to claim 1, wherein said resistor is provided on the surface side of said substrate which is opposed to the recording material.

4. An image heating apparatus according to claim 1, wherein said resistor is provided on the opposite surface side opposite to the surface side of said substrate which is opposed to the recording material.

5. An image heating apparatus according to claim 1, wherein said surface insulating layer on the opposite surface side opposite to the surface side opposed to the recording material is greater in surface roughness than said surface insulating layer on the surface side opposed to the recording material.

6. An image heating apparatus according to claim 1, wherein said surface insulating layers are glass layers.

7. An image heating apparatus according to claim 1, wherein said heater further includes an electrode for supplying electric power to said heat generating resistor, said electrode being formed on said intermediate insulating layer.

8. An image heating apparatus according to claim 1, further comprising film slidable relative to said heater, wherein the image on the recording material is heated by heat from said heater through said film.

9. A heater comprising:

a heat generating resistor;

an electrically conductive substrate;

an intermediate insulating layer formed between said resistor and said substrate; and two surface insulating layers provided respectively on substantially entire areas of both surface sides of said substrate;

wherein said two surface insulating layers differ in heat conductivity from each other.

10. A heater according to claim 9, wherein a heat conductivity of said intermediate insulating layer between said resistor and said substrate is the same as a heat conductivity of one of said surface insulating layers.

11. A heater according to claim 9, wherein one of said surface insulating layers which is smaller in heat conductivity is greater in surface roughness than the other of said surface insulating layers greater in heat conductivity.

12. A heater according to claim 9, wherein said surface insulating layers are glass layers.

13. An image heating apparatus for heating an image formed on a recording material, comprising:

a heater including a heat generating resistor, an electrically conductive substrate and surface insulating layers provided on both surface sides of said substrate, wherein said surface insulating layer on an opposite surface side opposite to a surface side of said substrate which is opposed to the recording material is greater in surface roughness than a surface insulating layer on the surface side which is opposed to the recording material.

14. An image heating apparatus according to claim 13, wherein said heater further includes an insulating layer between said resistor and said substrate.

15. An image heating apparatus according to claim 13, wherein said resistor is provided on the surface side of said substrate which is opposed to the recording material.

16. An image heating apparatus according to claim 13, wherein said resistor is provided on the opposite surface side opposite to the surface side of said substrate which is opposed to the recording material.

17. An image heating apparatus according to claim 13, wherein said surface insulating layers are glass layers.

18. An image heating apparatus according to claim 14, wherein said heater further includes an electrode for supplying electric power to said heat generating resistor, said electrode being formed on said insulating layer.

19. An image heating apparatus according to claim 13, further comprising film slidable relative to said heater, wherein the image on the recording material is heated by heat from said heater through said film.

20. A heater comprising:

a heat generating resistor;

an electrically conductive substrate; and surface insulating layers provided on both surface sides of said substrate, wherein said surface insulating layers differ in surface roughness from each other.

21. A heater according to claim 20, further comprising an insulating layer between said resistor and said substrate.

22. A heater according to claim 20, wherein said surface insulating layers are glass layers.

23. An image heating apparatus for heating an image formed on a recording material, comprising:

a heater including a heat generating resistor, an electrically conductive substrate and surface insulating layers provided on both surface sides of said substrate; and a temperature detecting element for detecting a temperature of said heater, wherein an area of said heater to which said temperature detecting element is opposed is higher in heat conductivity than a peripheral area of the area.

24. An image heating apparatus according to claim 23, wherein said surface insulating layers are not provided in the area to which said temperature detecting element is opposed.

25. An image heating apparatus according to claim 23, wherein a thickness of a portion of a surface insulating layer in the area to which said temperature detecting element is opposed is smaller than a thickness of the peripheral area.

26. An image heating apparatus according to claim 23, wherein a surface roughness of a portion of a surface insulating layer in the area to which said temperature detecting element is opposed is smaller than a surface roughness of the peripheral area.

27. An image heating apparatus according to claim 23, wherein a heat conductivity of a portion of a surface insulating layer in the area to which said temperature detecting element is opposed is higher than a heat conductivity of the peripheral area.

28. An image heating apparatus according to claim 23, wherein said temperature detecting element has an insulating protective layer on the surface thereof.

29. An image heating apparatus according to claim 23, wherein a surface insulating layer on a surface side of said substrate which is opposed to the recording material is higher in heat conductivity than a surface insulating layer on an opposite surface side of said substrate.

30. An image heating apparatus according to claim 23, wherein a surface insulating layer on a surface side opposite to a surface side opposed to the recording material is greater in surface roughness than a surface insulating layer on the surface side opposed to the recording material.

31. An image heating apparatus according to claim 23, wherein said heater further includes an insulating layer between said resistor and said substrate.

32. An image heating apparatus according to claim 23, wherein said resistor is provided on a surface side of said substrate which is opposed to the recording material.

33. An image heating apparatus according to claim 23, wherein said resistor is provided on a surface side opposite to a surface side of said substrate which is opposed to the recording material.

34. An image heating apparatus according to claim 23, further comprising film slidable relative to said heater, wherein the image on the recording material is heated by heat from said heater through said film.

35. A heater comprising:

a heat generating resistor;

an electrically conductive substrate; and surface insulating layers provided on both surface sides of said substrate, wherein one surface of said heater has in a lengthwise portion thereof an area higher in heat conductivity than a peripheral area of the area.

36. A heater according to claim 35, wherein said surface insulating layers are not provided in the area higher in heat conductivity.

37. A heater according to claim 35, wherein a thickness of a surface insulating layer in the area higher in heat conductivity is smaller than a thickness of the surface insulating layer in the peripheral area.

38. A heater according to claim 35, wherein a surface roughness of a surface insulating layer in the area higher in heat conductivity is smaller than a surface roughness of the surface insulating layer in the peripheral area.

39. A heater according to claim 35, wherein a heat conductivity of a surface insulating layer in the area higher in heat conductivity is higher than a heat conductivity of the surface insulating layer in the peripheral area.

40. A heater according to claim 35, wherein a surface insulating layer on one surface side of said substrate is higher in heat conductivity than a surface insulating layer on an opposite surface side of said substrate.

41. A heater according to claim 35, wherein a surface insulating layer on one surface side of said substrate is greater in surface roughness than a surface insulating layer on an opposite surface side of said substrate.

42. A heater according to claim 35, further comprising an insulating layer between said resistor and said substrate.

43. A heater according to claim 35, wherein the area higher in heat conductivity is provided on a surface side opposite to a surface side of said substrate on which said resistor is provided.

44. A heater according to claim 35, wherein the area higher in heat conductivity is provided on a surface side of said substrate on which said resistor is provided.

* * * * *

UNITED STATES PATENT AND TRADEMARK OFFICE

CERTIFICATE OF CORRECTION

PATENT NO. : 6,730,878 B2
DATED : May 4, 2004
INVENTOR(S) : Masahide Hirai

It is certified that error appears in the above-identified patent and that said Letters Patent is hereby corrected as shown below:

Column 8,
Line 40, “layers,” should read -- layer, --.

Column 10,
Line 24, “when” should read -- and when --.

Column 15,
Line 4, “about” should read -- abut --.

Column 16,
Line 62, “bettered” should read -- made better --.

Signed and Sealed this

Tenth Day of August, 2004

JON W. DUDAS
*Acting Director of the United States Patent and Trademark Office*